United States Patent [19]

Crown et al.

[11] Patent Number: 4,784,416

[45] Date of Patent: Nov. 15, 1988

[54] DOOR LATCH

[75] Inventors: Marlin D. Crown, Sycamore; James R. Johnston, Sterling, both of Ill.

[73] Assignee: National Manufacturing Co., Sterling, Ill.

[21] Appl. No.: 466,486

[22] Filed: Feb. 15, 1983

[51] Int. Cl.[4] ..... E05B 15/02

[52] U.S. Cl. ..... 292/341.15; 292/DIG. 30

[58] Field of Search ..... 292/341.15, 254, 9, 292/34, 35, DIG. 30

[56] References Cited

U.S. PATENT DOCUMENTS

| | | | |
|---|---|---|---|
| 3,188,840 | 6/1965 | Wartian | 292/254 X |
| 3,333,879 | 8/1967 | Quinn | 292/341.15 X |
| 3,872,696 | 3/1975 | Geringer | 292/254 X |
| 3,936,084 | 2/1976 | Orr | 292/DIG. 30 X |

*Primary Examiner*—Lloyd A. Gall

*Attorney, Agent, or Firm*—Edmond T. Patnaude

[57] ABSTRACT

The lock button on a door latch is slidable in a horizontal direction between a retracted unlocking position and an extended locking position wherein it blocks a latch hook release member from unlatching the latch, prevents inadvertent locking of the door and extends alongside a strike shoulder on the associated door jamb to provide a secondary latch.

8 Claims, 2 Drawing Sheets

DOOR LATCH

The present invention relates in general to door latches of the type commonly used on screen doors and storm doors, and it relates in paricular to a new and improved latch for use with a spring-loaded retractable strike.

BACKGROUND OF THE INVENTION

Door latch mechanisms of this general type are mounted to the inside face of the door and may include a lock cylinder which is key operated from the outside of the door with a locking lever type actuator on the inside. In some latch designs a latch release blocking member is operatively connected to the lock actuator for movement of the actuator into a blocking position which prevents accidental closing and latching of the door when the latch is locked.

The strike assemblies which are ordinarily used with these types of prior art latches are fastened to the door jamb opposite the latch and employ a vertically extending strike pin which is laterally biased into a latch hook engaging position by means of a pair of coil springs. As the associated door swings closed, an external cam surface on the latch engages the strike pin and pushes it toward the jamb until a latching notch in the latch is opposite the pin, whereupon the pin snaps into the notch. Relatively precise adjustment of the latch and strike are required for proper operation of this type of latch.

SUMMARY OF THE INVENTION

Briefly, there is provided in accordance with the present invention a new and improved door latch which has no exposed screws, rivets, pivot shafts or the like and which includes a highly visible lock actuator, labeled to indicate the locking function, slidable in a horizontal direction between an extended latch locking position and a retracted latch releasing position. When the door is open and the lock actuator is in the locking position, the lock actuator prevents accidental closing of the door, but when moved to the locking position while the door is closed the lock actuator extends into a strike recess in the strike assembly mounted to the door jamb to provide a secondary or auxiliary latch which prevents unauthorized opening of the door.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT OF THE INVENTION

Figure 1:
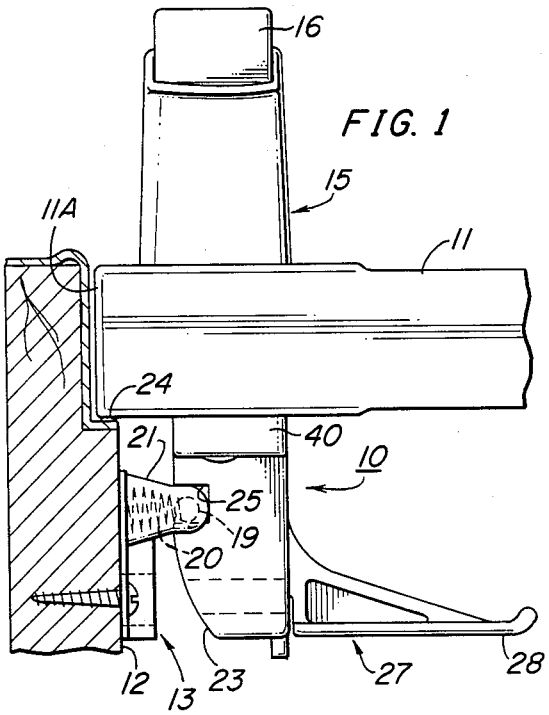
FIG. 1 is a top view of a door latch and strike embodying the present invention, the latch being mounted to a door and the strike being mounted to the associated door jamb.
Figure 2:
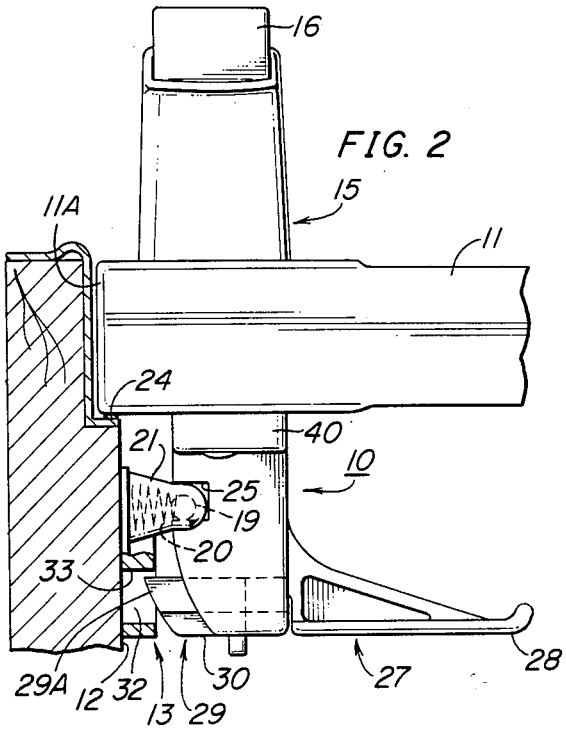
FIG. 2 is a view like that of FIG. 1, but showing the latch in a locked condition.
Figure 3:
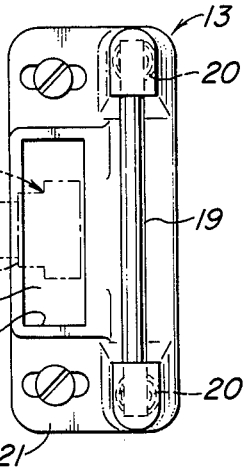
FIG. 3 is an elevational view of the latch of FIG. 1 the latch being shown in the unlocked condition.

Referring particularly to FIGS. 1, 2 and 3, a door latch assembly 10 is mounted to the inside face of a door 11 near its outer edge 11A in proximity to an associated door jamb 12 to which a strike assembly 13 is mounted. Any suitable outside handle 15 including a latch operating pushbutton 16 is mounted on the outside of the door and is operatively connected to the latch 10 by a shaft 17, best shown in FIGS. 7 and 11. In the illustrated embodiment of the invention the pushbutton 16 is part of a key operated cylinder and may be rotated by means of a key to turn the shaft 17 between a locked position and an unlocked position. Outside latch operators of this type are well known in the prior art.

Figure 8:
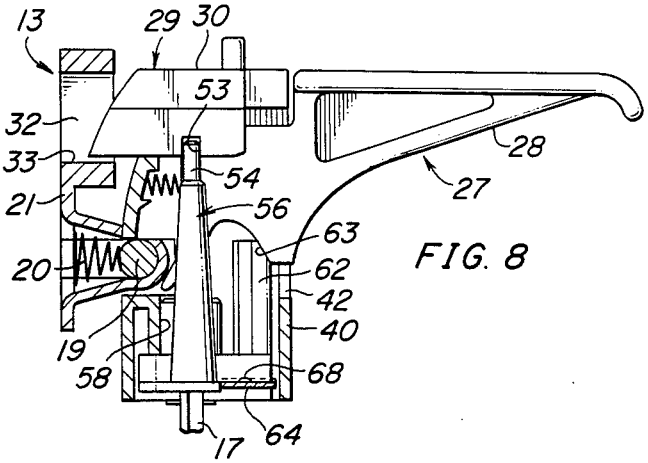
FIG. 8 is a view similar to that of FIG. 7, but showing the latch in the locked condition.
Figure 9:
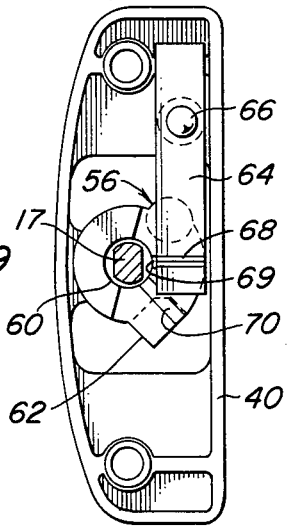
FIG. 9 is a view taken from the bottom of FIG. 7.
Figure 10:
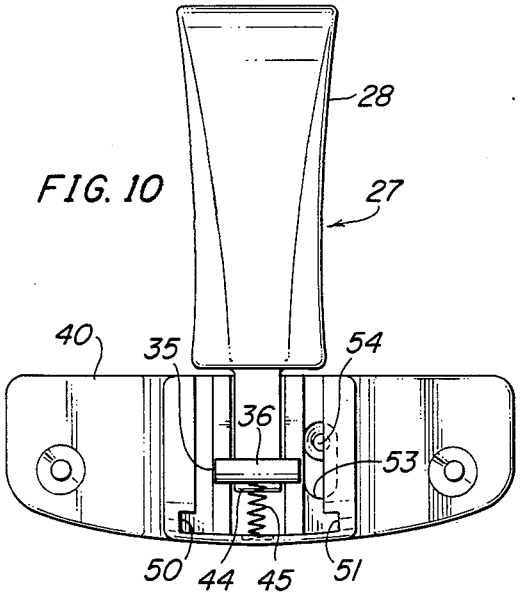
FIG. 10 is a view similar to that of FIG. 4, but with the lock actuator button removed.

The strike assembly 13 may be seen to include a vertically extending, rigid strike pin and bar 19 whose ends respectively extend into horizontal guide slots in a strike case 21 which, as best shown in FIG. 8, is resiliently urged in a horizontal direction away from the jamb 12 by a pair of conical coil springs 20.

The strike assembly 13 and the latch assembly 10 are positioned relative to one another so that as the door swings from the open to the closed position, courterclockwise as viewed in FIG. 1, the strike pin 19 is engaged by an arcuate cam surface 23 on the latch case and is moved laterally to a retracted position in close proximity to the jamb 12 to permit the latch to pass by the strike pin 19 as the door moves into its fully closed position against a stop surface 24 on the jamb. When thus positioned, the strike pin 19 is opposite a notch 25 in the latch case 40, and the strike pin is moved into the notch by the strike springs 20 thereby to latch the door in the closed position.

The latch 10 includes a pivotable release member 27 for pushing the strike pin 19 toward the jamb out of the notch 25 in the latch case 40 to permit the door 11 to be opened. The release member 27 is provided with an integral handle 28 which may be used to pull the door 11 into the closed position and which may also be used to release the latch and to push the door open. When opening the door from the outside, the release member is pivoted to the strike pin release position by depressing the push button 16 and thus moving the shaft 17 along its longitudinal axis toward the latch 10.

Figure 4:
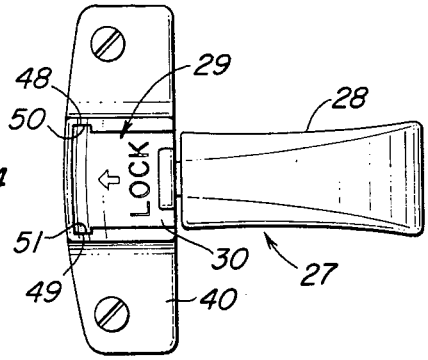
FIG. 4 is a front elevational view of the latch of FIG. 1, the latch being shown in the unlocked condition.
Figure 5:
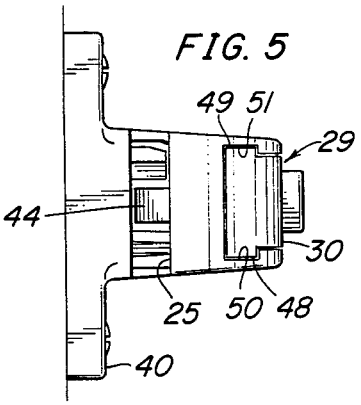
FIG. 5 is an elevational view as seen from the left side of FIG. 1.
Figure 6:
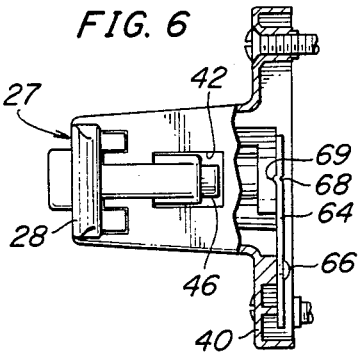
FIG. 6 is an elevational view as seen from the right side of FIG. 1.
Figure 7:
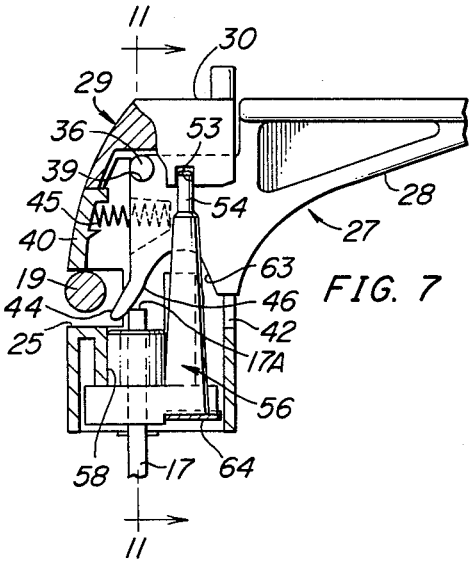
FIG. 7 is a partly sectioned view of the latch of FIG. 1, the latch being shown in the unlocked condition.

In order to lock the door in the closed position, the latch 10 includes a lock actuator member 29 which is movable between a retracted unlocked position as best shown in FIGS. 1, 4 and 7 and an extended locked position as best shown in FIGS. 2 and 8. When in the extended locked position, the actuator extends toward the door jamb and a flat surface 30 thereon will abut the strike pin 19 as the door swings toward a closed position, thereby to prevent the accidental closing of the door with the latch in a locked condition. However, when the locking member 29 is moved from the unlocked to the locked position while the door is fully closed, the outer end portion 29A thereof will extend into a recess 32 in the strike case 21 adjacent a strike shoulder 33 thereby to function as a keeper to provide an auxilary or secondary latch bolt which further prevents unauthorized opening of the door.

As best shown in FIG. 2, the lock actuator 29 is spaced a short distance from the strike shoulder 33 when the door is tightly closed and the strike pin 19 is in the notch of the latch hook. Consequently, the actuator 29 can be slidably moved into the locking position when the latch assembly and the strike assembly are not precisely aligned with one another. For example, if for any reason such as the accumulation of snow or ice on the bottom of the door, warpage of the door, or misadjustment of the strike assembly and/or latch assembly, the strike pin 19 will not move into the latch notch when the door is fully closed, it is still possible in most cases to latch the door closed by moving the actuator 29 into the strike recess 32. Hence, undesired opening of the door for any reason, including attempting to pick the lock by compressing the strike pin through external means, or by a strong wind, is prevented.

As mentioned hereinabove, the outside push button mechanism 16 may include a key-operated lock cylinder which is connected to the shaft 17 for rotating the shaft 17 to move the lock member 29 between the locked and unlocked positions.

As thus far described, it will be apparent that the lock actuator 29 is disposed in a highly visible location on the exposed face of the latch and is slidable toward and away from the strike assembly to lessen the chance that the latch will be accidentally left in the unlocked condition. Referring to FIG. 4, the embossed letters "lock" and arrow on actuator 29 clearly indicates the function to the user. In addition, the lock actuator 29 is itself an auxiliary positive latching member which makes unauthorized opening of the door more difficult and which can be used as the principal latch when the latch case fails to catch the strike pin 19.

Referring particularly to FIGS. 5 through 11, it may be seen that the release member 27 includes integral, axially aligned stub shaft portions 35 and 36 which are journaled in bearing surfaces 38 and 39 in the latch case 40. The handle portion 28 of the release member 27 extends out of the case 40 through an elongated opening 42 to permit the release member to be pivoted in a clockwise direction as shown in FIG. 7 to cause a tongue portion 44 to move against the strike pin 19 and push it out of the notch 25 to release the latch. A coil spring 45 resiliently urges the release member in a counterclockwise direction into the set or latched position as illustrated in FIG. 7. The distal end 17A of shaft 17 abuts a cam surface 46 on the release member so that depresssion of the release button 16 on the outside of the door pivots the release member in a clockwise direction into the latch release position.

Figure 11:
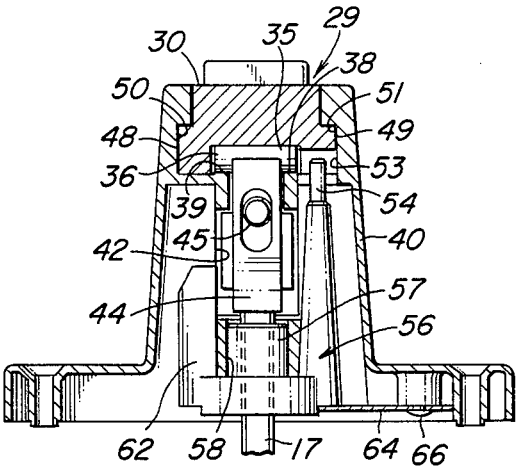
FIG. 11 is a cross-sectional view taken along the line 11—11 of FIG. 7.

The lock actuator 29, as best shown in FIG. 11, has external side flanges 48 and 49 which are slidably disposed in guide grooves 50 and 51 in the case 40. The actuator 29 overlies the release member 27 and holds it against the bearing surface 38 and 39 in assembled relationship within the case 40.

A slot 53 is provided in the flange 49 of the lock actuator 29 and receives an upstanding pin 54 on a latch release blocking member 56 which is mounted for partial rotary movement in the case 40. The pin 54 thus prevents complete removal of the lock actuator 29 from the case 40. The blocking member 46 includes an integral, centrally disposed cylindrical bearing part 57 which extends into a journal 58 in the case 40. The bearing part 57 has a central hole 60 through which the shaft 17 extends and thus provides a guide for the shaft. The shaft 17 has a double-D cross-section and the hole 60 is complimentary thereto whereby rotation of the shaft 17 rotates the blocking member 56. The shaft 17 may be of any other suitable shape which will permit independent axial movement of the shaft 17 through the hole 60 while locking the parts against independent rotary movement.

It may be seen that horizontal sliding movement of the lock actuator 29 is translated into rotary motion of the blocking member 56 within the journal 58. Consequently, when the actuator 29 is slidably moved from the unlocking, retracted position shown in FIG. 7 to the extended locking position shown in FIG. 8, the blocking member 56 is rotated through forty-five degrees, and an upstanding blocking part 62 on the member 56 moves adjacent a lug surface 63 on the release member 27 thereby to prevent pivotal movement of the release member 27 from the normal position shown in FIG. 1 to the unlatching position. It will be understood that rotation of the shaft 17 will also rotate the blocking member and such rotation will be translated into rectilinear sliding movement of the actuator 29 between the extended and retracted positions. Accordingly, when the latch is locked from the outside, the auxiliary latch, i.e., the actuator 29, is also engaged.

As best shown in FIGS. 6, 7, 8 and 9, the blocking member 56 is held in assembled relationship within the body of the case 40 by means of a leaf spring 64 which is attached by staking raised boss 66 on the case 40 over the spring 64. The spring 64 also functions to prevent spurious rotation of the blocking member 46 between the locked and unlocked positions. To this end the spring 64 includes a raised detent surface 68 which is adapted to extend into a pair of radial grooves 69 and 70 provided in the base of the blocking member 56. The grooves 69 and 70 are spaced forty-five degrees apart and respectively receive the detent surface 68 when the blocking member is in the locked or unlocked position.

It may thus be seen that the release member 27 is held in assembled relationship in the case 40 by the lock actuator 29 which is in turn held in assembled relationship within the case 40 by the blocking member 46 which itself is held in assembled relationship within the case 27 by the spring element 64. Therefore, the staking of boss 66 holds the entire latch in assembled relationship. Moreover, there are no exposed pivot shafts or the like to detract from the appearance of the latch. The lock actuator is clearly visible wherefor it is visually apparent whether or not the latch is in the locked position. Also, being relatively large, the lock actuator is strong and durable and not easily broken.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A door latch mechanism adapted to be mounted to one face of a swingable door for operative latching engagement with a strike assembly mounted to the associated door jamb at a position to intercept said latch mechanism upon closing movement of the door, said strike assembly including a fixed strike surface and a laterally moveable, retractable strike, said latch mechanism comprising a latch case having a notch adapted to receive said strike when said door is closed, release means carried by said case for movement toward and away from said jamb when said door is closed for pushing said strike out of latching engagement with said notch, a lock actuator mounted to said case for movement between a retracted, unlocked position out of engagement with said strike surface on said jamb and an extended, locked position wherein a portion thereof extends into operative, locking engagement with said strike surface, and blocking means connected to said lock actuator for blocking the movement of said release means toward said jamb when said lock actuator is in said extended, locked position.

2. A door latch mechanism according to claim 1, comprising a cam surface on said latch case which is positioned to engage said strike as said door swings into its closed position and to push said strike into a retracted position to permit a latch hook to pass said strike, and said strike assembly is disposed in the path of travel of said lock actuator when said door swings toward its closed position while said lock actuator is in said extended, locked position, thereby to prevent the complete closing of said door.

3. A door latch mechanism according to claim 2, wherein said cam surface is disposed on said lock actuator.

4. A door latch according to claim 1, comprising a shaft extending through said door into said latch case with the distal end of said shaft operatively engaging said release means for moving said release means toward said jamb in response to axial movement of said shaft, and means being operatively connected between said shaft and said lock actuator for moving said lock actuator between said extended and retracted positions in response to rotational movement of said shaft.

5. A door latch according to claim 1, comprising a shaft extending through said door into said latch case with the distal end of said shaft operatively engaging said release means for moving said release means toward said jamb in response to axial movement of said shaft, and said blocking means being operatively connected between said shaft and said lock actuator for moving said lock actuator between said extended and retracted positions in response to rotational movement of said shaft.

6. A door latch mechanism adapted to be mounted to one side of a swingable door for operative latching engagement with a strike assembly mounted to the associated door jamb at a position to intercept said latch mechanism upon closing movement of the door, said strike assembly including a laterally movable, retractable strike, said latch mechanism comprising a casing having a latch notch adapted to receive said strike when said door is closed, release means pivotally carried by said casing for movement toward and away from said jamb when said door is closed for pushing said strike out of latching engagement with said latch notch, a lock actuator mounted to said casing for rectilinear movement between an unlocked position and a locked position, blocking means including a blocking member journaled in said casing for arcuate movement between a blocking position and a non-blocking position and connected to said lock actuator for blocking the movement of said release means toward said jamb only when said actuator is in said locked position, said blocking member being mounted in a cavity opening at the base of said casing, a leaf spring mounted to said casing and extending across said opening to hold said blocking member in said cavity in operative relationship with said lock actuator, said blocking member further includes at least one detent surface in an end thereof adjacent said opening, said leaf spring has a detent surface to prevent spurious movement of said blocking member, and said blocking member includes a protuberance offset from the axis of arcuate movement of said blocking member and extending into a recess in said lock actuator, said protuberance preventing disassembly of said lock actuator from said casing.

7. A door latch mechanism according to claim 6, comprising bearing surface means disposed internally of said casing, said release means being pivotally disposed against said bearing surface, and said lock actuator holding said release means in assembled relationship with said casing.

8. A door latch mechanism according to claim 7 wherein said bearing surface is integral with said casing.

* * * * *